US007055652B1

(12) United States Patent
Williams

(10) Patent No.: US 7,055,652 B1
(45) Date of Patent: Jun. 6, 2006

(54) HOLDER FOR SUPPORTING TOOLS AND OTHER OBJECTS FROM A LADDER

(76) Inventor: John Williams, 21522 Full Moon Ct., Grass Valley, CA (US) 95949

( * ) Notice: Subject to any disclaimer, the term of this patent is extended or adjusted under 35 U.S.C. 154(b) by 240 days.

(21) Appl. No.: 10/640,088

(22) Filed: Aug. 13, 2003

(51) Int. Cl.
*E04G 1/36* (2006.01)
*B65D 85/28* (2006.01)

(52) U.S. Cl. ..... 182/129; 206/373

(58) Field of Classification Search ..... 182/129, 182/230, 121; 248/210, 238, 211; 206/372, 206/373; 220/570, 576, 523, 735; D25/68
See application file for complete search history.

(56) References Cited

U.S. PATENT DOCUMENTS 4,356,854 A * 11/1982 McGee ..... 182/129
4,773,535 A * 9/1988 Cook ..... 206/373
5,603,405 A * 2/1997 Smith ..... 206/373
5,638,915 A * 6/1997 Hardy ..... 182/129
5,647,453 A * 7/1997 Cassells ..... 182/129
5,749,437 A * 5/1998 Weller ..... 182/129
5,971,101 A * 10/1999 Taggart ..... 182/129
5,988,383 A * 11/1999 Armstrong ..... 206/373
6,766,881 B1 * 7/2004 Carty ..... 182/129

OTHER PUBLICATIONS

The Ladder Boss tool holder & Material Handler made available by Ladder Boss of Valley Center, CA, no month & date available.
The Model AC33 Multi-pocket tool holder, no month & date available.
The four-sided, Multi-pocket ladder caddy Model AC32, no month & date available.
Model AC31 made available by Werner Co., no month & date available.

* cited by examiner

*Primary Examiner*—Hugh B. Thompson, II
(74) *Attorney, Agent, or Firm*—Thomas R. Lampe

(57) ABSTRACT

A holder for holding tools and other objects is releasably connected to a ladder by a securement strap. The holder includes holder front and side panels which are free to shift position under the influence of gravity relative to the ladder upon tilting of the ladder to prevent tools or other objects held by the holder front and side panels from falling.

3 Claims, 2 Drawing Sheets

HOLDER FOR SUPPORTING TOOLS AND OTHER OBJECTS FROM A LADDER

TECHNICAL FIELD

This invention relates to a holder for tools and other objects. More particularly, the holder is utilized with a ladder to support the tools and other objects from the ladder. The holder includes panels having pockets. The panels are not directly attached to the ladder, enabling the panels to shift position under the influence of gravity relative to the ladder when the ladder is tilted from a vertical orientation. This prevents tools or other objects held by the holder pockets from becoming disengaged from the holder and falling therefrom.

BACKGROUND OF THE INVENTION

It is known to provide tool holders and caddies which are applied to ladders. Examples of such arrangements are The Ladder Boss tool holder and material handler made available by Ladder Boss of Valley Center, Calif. and the Model AC33 multi-pocket tool holder, the four-sided, multi-pocket ladder caddy Model AC32 and the four-sided, multi-pocket tool holder Model AC31 made available by Warner Co.

A problem is encountered with respect to the prior art holder and caddy arrangements in that tilting of a ladder can cause tools and other objects held thereby to fall out of the device. Most commonly, this happens when the ladder is being moved or repositioned by the user.

DISCLOSURE OF INVENTION

The present invention relates to a holder for holding tools and other objects which is utilized in combination with a ladder having a ladder top, a ladder front, a ladder back and ladder sides.

The holder includes a holder top panel positioned over and engaging the ladder top and a holder front panel attached to the holder top panel and depending downwardly therefrom to partially cover the ladder front.

At least one securement strap extends between and interconnects the holder top panel and the ladder retaining the holder top panel in engagement with the ladder top to at least partially cover the ladder top and prevent substantial relative movement between the holder top panel and the ladder top.

The holder front panel is flexible and has a free front holder panel lower distal end spaced from and disposed below the holder top panel. The holder front panel is not directly attached to the ladder whereby the holder front panel is free to shift position under the influence of gravity relative to the ladder and relative to the holder top panel upon tilting of the ladder from a vertical orientation to prevent tools or other objects held by the holder front panel from becoming disengaged from the holder front panel and falling from the holder.

Other features, advantages and objects of the present invention will become apparent with reference to the following description and accompanying drawings.

BEST MODE FOR CARRYING OUT THE INVENTION

Figure 1:
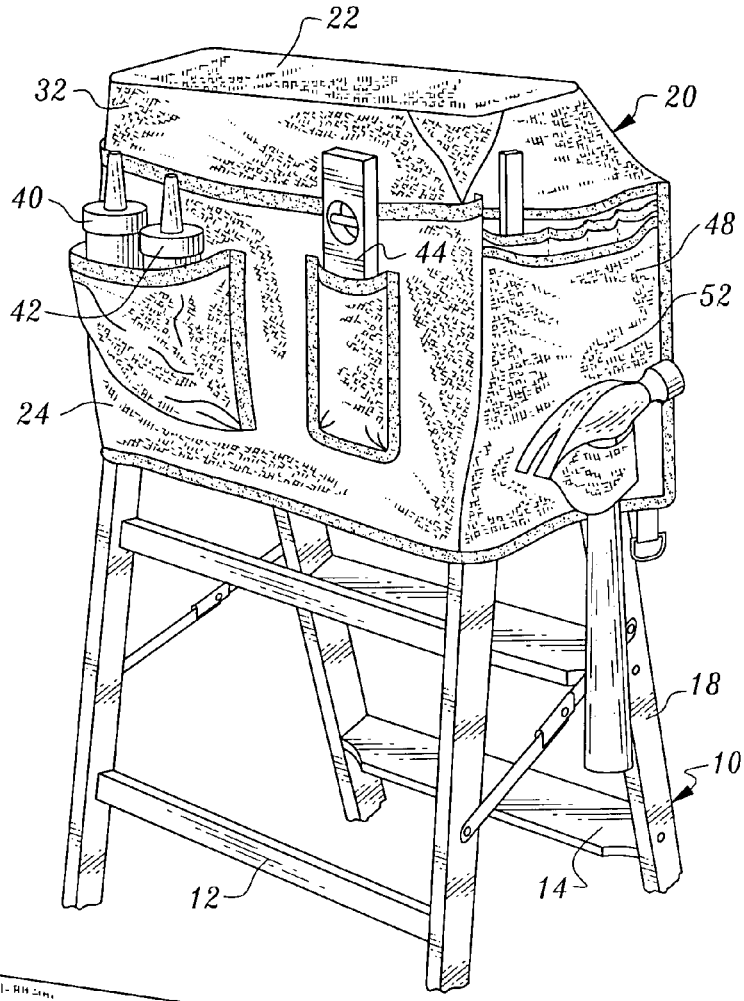
FIG. 1 is a frontal, perspective view of a preferred embodiment of the invention utilized in combination with a step ladder to hold tools and other objects.
Figure 2:
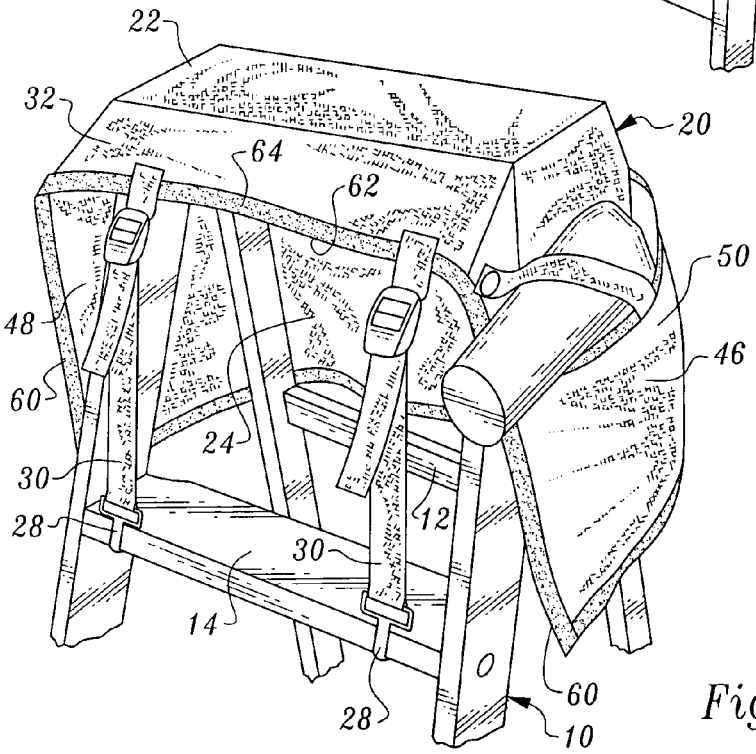
FIG. 2 is a view similar to FIG. 1, but being a rear, perspective view showing the back of the holder and securement straps employed to releasably secure the holder to the step ladder.
Figure 4:
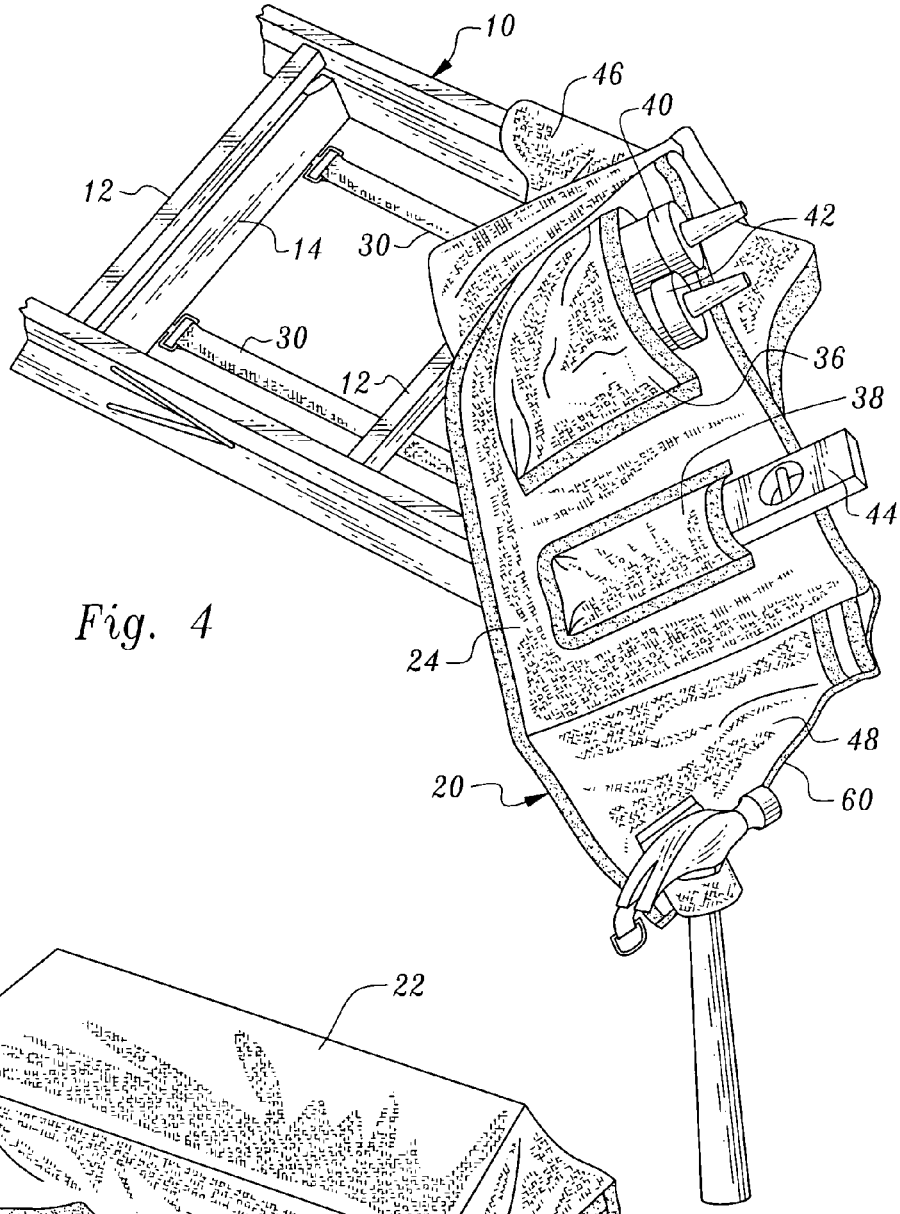
FIG. 4 is a perspective view showing the condition of the holder and tools and other objects held thereby when the step ladder has been tilted from the vertical, for example when the step ladder is being moved or repositioned.
Figure 3:
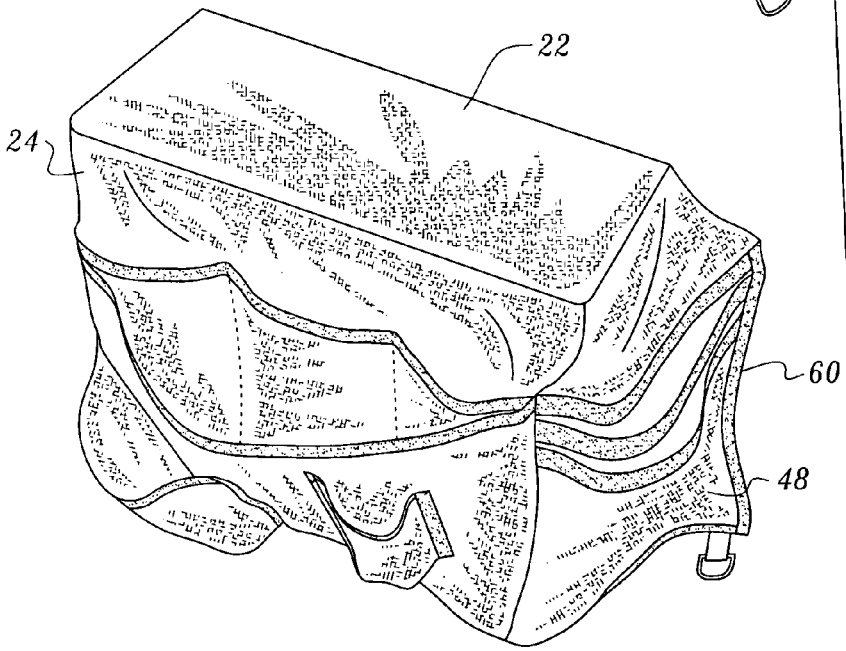
FIG. 3 is a frontal, perspective view of the holder removed from the step ladder.

Referring now to the drawings, a conventional step ladder 10 is illustrated. The step ladder is shown in FIGS. 1 and 2 in its vertical orientation employed during use. In FIG. 4, the pivoted step ladder segments have been collapsed and the step ladder is shown tilted, as for example when the step ladder is being moved or repositioned by an individual carrying ladder.

As is conventional, the step ladder includes conventional rungs 12 and rungs in the form of steps 14 located respectively on step ladder sections 16 and 18. For purposes of convenience and by way of illustration and discussion, the ladder section 16 will be considered the ladder front and the ladder section 18 will be considered the ladder back.

The holder of the invention is designated by reference numeral 20 and includes a holder top panel 22 positioned over and engaging the conventional step ladder top and a holder front panel 24 attached to the holder top panel and depending downwardly therefrom to partially cover the ladder front, i.e. ladder section 16. It will be appreciated, however, that the holder could, if desired, be oriented relative to the step ladder so that the holder front panel partially covers ladder section 18 section instead. In that instance, the ladder section 18 would be considered the ladder front and ladder section 16 would be considered the ladder back in conformance with the location of the holder front panel 24.

Securement straps 30 extend between and interconnect the holder top panel and the ladder, retaining the holder top panel in engagement with the ladder top to cover the ladder top and prevent substantial relative movement between the holder top panel and the ladder top. Snap hooks 28 on the straps lockingly engage the top step of the ladder. The flexible holder top panel includes a flexible holder top panel portion 32 which extends downwardly from the ladder top.

The holder front panel is also formed of flexible material and has a free front holder panel lower distal end 34 spaced from and disposed below the holder top panel. The holder front panel is not directly attached to the ladder. Thus, the holder front panel is free to shift position under the influence of gravity relative to the ladder and relative to the holder top panel upon tilting of the ladder from a vertical orientation to prevent tools or other objects held by the holder front panel from becoming disengaged from the holder front panel and falling from the holder. This is illustrated in FIG. 4.

The holder front panel 24 includes open topped pockets 36, 38 holding objects 40, 42 and 44. It will be noted that shifting of position of the holder front panel relative to the ladder causes a shift of position of the open topped pockets 36, 38 relative to the ladder to maintain the open tops thereof disposed above the remainders of the pockets. Therefor, the force of gravity tends to maintain the objects in place in the pockets when the ladder is tilted from the vertical.

The holder 20 also includes holder side panels 46, 48 which are attached to the holder top panel and depend downwardly therefrom to partially cover the ladder sides.

The holder side panels are also formed of flexible material and have free holder side panel lower distal ends spaced from and disposed below the holder top panel.

The holder side panels are not directly attached to the ladder whereby the holder side panels are free to shift position under the influence of gravity relative to the ladder and relative to the holder top panel upon tilting of the ladder from a vertical orientation to prevent tools or other objects held by the holder side panels from becoming disengaged from the holder side panels and falling from the holder. This shifting of position occurs simultaneously with the above-described shifting of position of the holder front panel since in this embodiment the holder side panels are secured to the front panel along the sides thereof.

Open topped pocket 50 is incorporated in holder side panel 46 and open topped pocket 52 is incorporated in holder side panel 48. The open tops of pockets 50, 52 will be maintained above the remainder of the pockets when the positions of the pockets 50, 52 shift along with the rest of the holder side panel structure due to tilting of the ladder.

The holder side panels 46, 48 have free holder side panel edges 60 spaced from the holder front panel which extend along the ladder sides and are spaced from one another to define a void 62 (see FIG. 2) at the ladder back and below the holder top panel. This enables the holder side panels to move freely to adjust for reorientation of the ladder without being interfered with by the ladder structure.

The holder top panel portion 32 is located over the void 62. A reenforcement strip 64 runs the length of the holder front panel to provide reenforcement at the location of interconnection of the securement strips 30 with the top panel portion 32.

The securement straps in the embodiment illustrated secure the holder top panel 22 to a step of the ladder. However, the securement straps could also be secured to ladder rungs not in the form of steps, including rungs of ladders not of the step ladder type. Also, if desired, the straps may loop around the rungs and not be secured thereto by snap hooks.

The invention claimed is:

1. A ladder having a ladder top, a ladder front, a ladder back and ladder sides;

a holder for holding tools and other objects, said holder including a holder top panel positioned over and engaging the ladder top and a holder front panel attached to the holder top panel and depending downwardly therefrom to partially cover said ladder front;

at least one securement strap extending between and interconnecting said holder top panel and said ladder retaining said holder top panel in engagement with said ladder top to at least partially cover the ladder top and prevent substantial relative movement between said holder top panel and said ladder top, said holder front panel being flexible and having a free front holder panel lower distal end spaced from and disposed below said holder top panel, said holder front panel not being directly attached to said ladder whereby said holder front panel is free to shift position under the influence of gravity relative to said ladder and relative to said holder top panel upon tilting of the ladder from a vertical orientation to prevent tools or other objects held by said holder front panel from becoming disengaged from said holder front panel and falling from said holder; and holder side panels attached to the holder top panel and depending downwardly therefrom to partially cover said ladder sides, said holder side panels being flexible and having free holder side panel lower distal ends spaced from and disposed below said holder top panel, said holder side panels not being directly attached to said ladder whereby said holder side panels are free to shift position under the influence of gravity relative to said ladder and relative to said holder top panel upon tilting of the ladder from a vertical orientation to prevent tools or other objects held by said holder side panels from becoming disengaged from said holder side panels and falling from said holder, said holder side panels having free holder side panel edges extending along said ladder sides and spaced from one another to define a void at the ladder back and below said holder top panel, said holder top panel including a flexible holder top panel portion extending downwardly from said ladder top over said void, and said ladder comprising a step ladder and said at least one securement strap extending between and securing together said flexible holder top panel portion and a step of said step ladder, and said flexible holder top panel portion including a reinforcement strip, said at least one securement strap being attached to said reinforcement strip.

2. In combination:

a ladder having a ladder top, a ladder front, a ladder back and ladder sides;

a holder for holding tools and other objects, said holder including a holder top panel positioned over an engaging the ladder top and a holder front panel attached to the holder top panel and depending downwardly therefrom to partially cover said ladder front;

at least one securement strap extending between and interconnecting said holder top panel and said ladder retaining said holder top panel in engagement with said ladder top to at least partially cover the ladder top and prevent substantial relative movement between said holder top panel and said ladder top, said holder front panel being flexible and having a free front holder panel lower distal end spaced from and disposed below said holder top panel, said holder front panel not being directly attached to said ladder whereby said holder front panel is free to shift position under the influence of gravity relative to said ladder and relative to said holder top panel upon tilting of the ladder from a vertical orientation to prevent tools or other objects held by said holder front panel from becoming disengaged from said holder front panel and falling from said holder; and holder side panels directly attached to the holder top panel and depending downwardly therefrom to partially cover said ladder sides, said holder side panels being flexible and having free holder side panel lower distal ends spaced from and disposed below said holder top panel, said holder side panels being directly attached to said holder front panel but not being directly attached to said ladder whereby said holder side panels are free to shift position under the influence of gravity relative to said ladder and relative to said holder top panel upon tilting of the ladder from a vertical orientation to prevent tools or other objects held by said holder side panels from becoming disengaged from said holder side panels and falling from said holder.

3. In combination:

a ladder having a ladder top, a ladder front, a ladder back and ladder sides;

a holder for holding tools and other objects, said holder including a holder top panel positioned over and engaging the ladder top and a holder front panel attached to the holder top panel and depending downwardly therefrom to partially cover said ladder front;

at least one securement strap extending between and interconnecting said holder top panel and said ladder retaining said holder top panel in engagement with said ladder top to at least partially cover the ladder top and prevent substantial relative movement between said holder top panel and said ladder top, said holder front panel being flexible and having a free front holder panel lower distal end spaced from and disposed below said holder top panel, said holder front panel not being directly attached to said ladder whereby said holder front panel is free to shift position under the influence of gravity relative to said ladder and relative to said holder top panel upon tilting of the ladder from a vertical orientation to prevent tools or other objects held by said holder front panel from becoming disengaged from said holder panel and falling from said holder; and holder side panels attached to the holder top panel and depending downwardly therefrom to partially cover said ladder sides, said holder side panels being flexible and having free holder side panel lower distal ends spaced from and disposed below said holder top panel, said holder side panels not being directly attached to said ladder whereby said holder side panels are free to shift position under the influence of gravity relative to said ladder and relative to said holder top panel upon tilting of the ladder from a vertical orientation to prevent tools or other objects held by said holder side panels from becoming disengaged from said holder side panels and falling from said holder, said holder side panels having free holder side panel edges extending along said ladder sides and spaced from one another to define a void at the ladder back and below said holder top panel, said holder top panel including a flexible holder top panel portion extending downwardly from said ladder top over said void, and said ladder including a rung, said at least one securement strap having a hook connected thereto and extending between and securing together said flexible top panel portion and said rung due to locking engagement of the hook with said rung.

* * * * *